US008593367B2

(12) United States Patent
Ali et al.

(10) Patent No.: US 8,593,367 B2
(45) Date of Patent: Nov. 26, 2013

(54) MODIFIED GROUND PLANE (MGP) APPROACH TO IMPROVING ANTENNA SELF-MATCHING AND BANDWIDTH

(75) Inventors: Shirook M. Ali, Milton (CA); Houssam Kanj, Waterloo (CA)

(73) Assignee: BlackBerry Limited, Waterloo (CA)

( * ) Notice: Subject to any disclaimer, the term of this patent is extended or adjusted under 35 U.S.C. 154(b) by 432 days.

(21) Appl. No.: 12/965,300

(22) Filed: Dec. 10, 2010

(65) Prior Publication Data

US 2012/0146875 A1 Jun. 14, 2012

(51) Int. Cl.
*H01Q 1/48* (2006.01)

(52) U.S. Cl.
USPC ..... 343/848; 343/700 MS; 343/702

(58) Field of Classification Search
USPC ..... 343/700 MS, 702, 846, 848
See application file for complete search history.

(56) References Cited

U.S. PATENT DOCUMENTS

| | | | | |
|---|---|---|---|---|
| 6,950,068 | B2 * | 9/2005 | Bordi et al. | 343/702 |
| 7,369,092 | B1 | 5/2008 | Wen et al. | |
| 7,505,446 | B2 | 3/2009 | Pecen | |
| 7,508,346 | B2 | 3/2009 | Rao et al. | |
| 7,511,670 | B2 | 3/2009 | Rao et al. | |
| 7,564,815 | B2 | 7/2009 | Pecen et al. | |
| 7,564,823 | B2 | 7/2009 | Pecen et al. | |
| 7,583,640 | B2 | 9/2009 | Pecen et al. | |
| 7,598,913 | B2 | 10/2009 | Rao et al. | |
| 7,629,932 | B2 | 12/2009 | Wang et al. | |
| 7,705,783 | B2 | 4/2010 | Rao et al. | |
| 7,710,324 | B2 * | 5/2010 | Tatarnikov et al. | 343/700 MS |
| 7,714,795 | B2 | 5/2010 | Wen et al. | |
| 7,719,470 | B2 | 5/2010 | Wang et al. | |
| 7,773,040 | B2 | 8/2010 | Rao et al. | |
| 7,773,996 | B2 | 8/2010 | Pecen et al. | |
| 7,777,684 | B2 | 8/2010 | Rao et al. | |
| 2008/0079635 | A1 | 3/2008 | Rowell | |
| 2008/0094290 | A1 | 4/2008 | Wen et al. | |
| 2009/0051596 | A1 | 2/2009 | Wen et al. | |
| 2009/0058734 | A1 | 3/2009 | Ali et al. | |
| 2009/0115664 | A1 * | 5/2009 | Chung et al. | 343/700 MS |
| 2010/0197263 | A1 | 8/2010 | Dwyer et al. | |

FOREIGN PATENT DOCUMENTS

| | | | |
|---|---|---|---|
| WO | 03077360 | A1 | 9/2003 |

OTHER PUBLICATIONS

International Search Report and Written Opinion for PCT Patent Application No. PCT/CA2011/050760, mailed Mar. 15, 2012.

* cited by examiner

*Primary Examiner* — Tan Ho
(74) *Attorney, Agent, or Firm* — Moffat & Co.; Timothy Clise; Joseph L. Ulvr

(57) ABSTRACT

An antenna design technique which allows antennas to be self-matched while supporting multi-band and broadband operations. The technique includes adding a raised and curved ground plane section electrically coupled to the ground plane. The curved ground plane section allows for a smooth transition of the surface current hence a boarder bandwidth is achieved. A slit positioned between the ground plane and the ground plane section can also be used to further improve the antenna bandwidth. The technique does not increase the antenna thickness neither its volume, thus allowing application in slim handheld device applications such as flip phones. Using this technique, a narrow band antenna is made broadband to cover several frequency bands of interest. The technique is applied to a quad-band antenna to broaden its bandwidth to become a sept-band antenna. The technique is used to also improve the antenna match at all the seven bands it supports.

18 Claims, 8 Drawing Sheets

MODIFIED GROUND PLANE (MGP) APPROACH TO IMPROVING ANTENNA SELF-MATCHING AND BANDWIDTH

BACKGROUND OF THE INVENTION

1. Field of the Invention

The present invention relates in general to the field of wireless communications and more specifically to the design and implementation of a modified ground plane approach to improving antenna self-matching and bandwidth.

2. Description of the Related Art

It is desirable for handheld devices to operate and support different communication standards and technologies. With the existence of several communication standards such as GSM 800/900/1800/1900, UMTS 2100, Bluetooth 2450 MHz, and 3GPP LTE standard (expected to operate at 700 MHz and/or 2600 MHz.), there is an ever mounting pressure on antenna designers to develop antenna designs that support all of the above frequency bands and fit the antenna in a small, slim, and stylish device. An additional requirement is present handsets that conform to the LTE standard support two receive antennas.

Attempting to develop an antenna that provides multi/broad-band performance and maintains a low profile and a compact size at the same time can be challenging. To realize a good antenna broadband self-match, certain antennas have been proposed with the idea of folding a monopole into its ground plane creating a two dimensional planar structures. One possible disadvantage of this approach is that the antenna will occupy a large surface on the PCB board. In addition, the antenna will not have a usable bandwidth below 3 GHz. Other antennas have been proposed which include the idea of folding a ground plane 90 degrees to form a corner-like reflector. While this approach potentially improves antenna performance, this idea is still a conventional approach that does not realize true broad-band performance.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
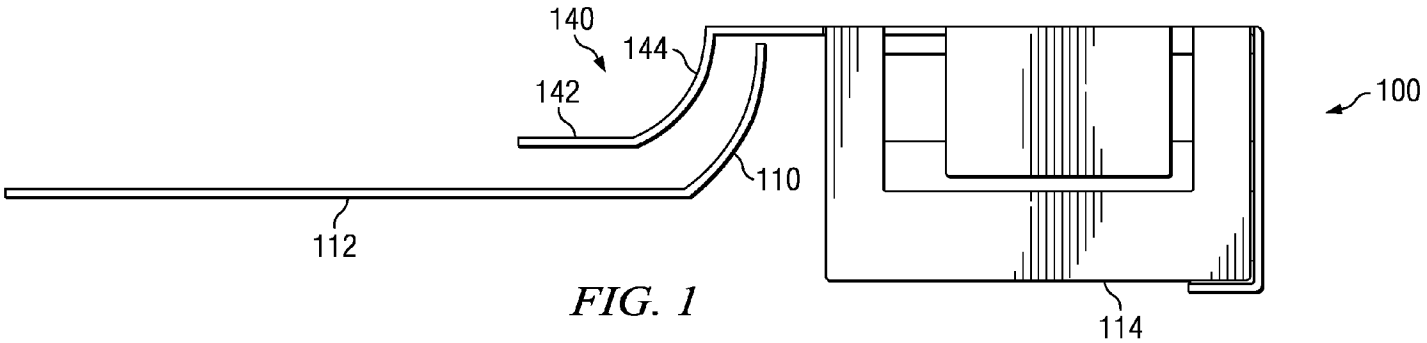
FIG. 1 shows a side view of an antenna in accordance with the present invention.

An antenna design technique is presented which allows antennas to be self matched while supporting multi-band and broadband operations. The technique does not increase the antenna thickness neither its volume, thus allowing application in slim handheld device applications such as flip phones. Using this technique, a narrow band antenna is made broadband to cover several frequency bands of interest. The technique is applied to a quad-band antenna to broaden its bandwidth to become a sept-band antenna. The technique is used to also improve the antenna match at all the seven bands it supports.

The technique allows a narrow-band antenna to be made broader such that it supports more frequency bands. For example, a quad-band antenna supporting 800/900/1800/1900 MHz can be made a sept-band antenna supporting GSM 800/900/1800/1900, UMTS 2100, Bluetooth 2450, and the proposed LTE 2600 MHz band.

The technique as applied to a specific antenna drastically improves the antenna multi-band and broadband performance, without increase in antenna volume or thickness.

Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the inventor's specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flow chart form, rather than in detail, in order to avoid limiting or obscuring the present invention. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, a combination of hardware and software, software, or software in execution. For example, a component may be, but is not limited to being, a process running on a processor, a processor, an object, an executable, a thread of execution, a program, or a computer. By way of illustration, both an application running on a computer and the computer itself can be a component. One or more components may reside within a process or thread of execution and a component may be localized on one computer or distributed between two or more computers.

As used herein, the terms "user equipment" and "UE" can refer to wireless devices such as mobile telephones, smart phones, personal digital assistants (PDAs), handheld or laptop computers, and similar devices or other user agents ("UAs") that have telecommunications capabilities. In some embodiments, a UE may refer to a mobile, wireless device. The term "UE" may also refer to devices that have similar capabilities but that are not generally transportable, such as desktop computers, set-top boxes, or network nodes.

The term "article of manufacture" (or alternatively, "computer program product") as used herein is intended to encompass a computer program accessible from any computer-readable device or media. For example, computer readable media can include but are not limited to magnetic storage devices (e.g., hard disk, floppy disk, magnetic strips, etc.), optical disks such as a compact disk (CD) or digital versatile disk (DVD), smart cards, and flash memory devices (e.g., card, stick, etc.).

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

Figure 2:
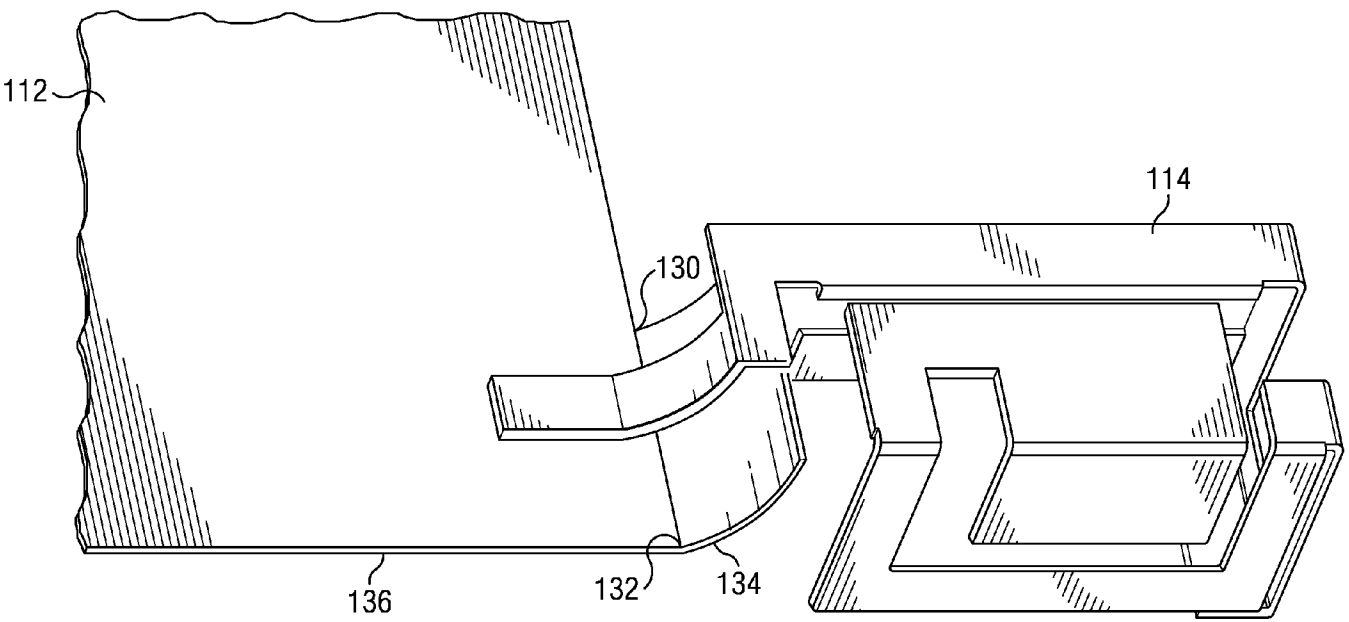
FIG. 2 shows a perspective view of an antenna in accordance with the present invention.

Referring to FIGS. 1 and 2, a side view and a perspective view of an antenna are shown. The antenna 100 includes a relatively small, substantially orthogonal ground plane section 110 positioned between a ground plane 112 and a radiating antenna element 114. In certain embodiments, the ground plane section 110 is substantially the same depth as the ground plane 112 and is substantially as wide as the radiating antenna element 114. More specifically, in certain embodiments, the ground plane section is 1.5 mm deep (+/−0.5 mm) and 7.5 mm wide (+/−1.5 mm) The width of the ground plane section 110 is within +/−20 percent of the width of the radiating element (see e.g., FIG. 2). Additionally, the ground plane 112 is 60 mm wide (+/−10 mm). Accordingly, the ground plane section 110 is substantially less wide than the ground plane 112.

The size of the ground plane affects the antenna performance. More specifically, a larger ground plane can relax the design of the antenna and its performance. However, the ground plane size in a handheld device is always confined to the handheld form factor. In the present antenna, an extended ground plane section 110 is positioned substantially perpendicular to the ground plane 112 and the radiating element 114, virtually increasing the ground plane size and hence improving the antenna performance. This positioning is made such that the overall ground plane size, hence the handheld device, remains the same.

In certain embodiments, the ground plane section 110 is planar and forms a substantially 90 degree angle with the ground plane 112. In other embodiments, the ground plane section 110 is curved and/or tapered away from the ground plane to guide the propagating wave excited by any radio frequency (RF) sources that are provided to the antenna 100. The curvature of the ground plane section 110 is such that an end of the ground plane section which is opposite that of the portion coupled to the ground plane 112 is perpendicular to the ground plane 112. By providing the curved ground plane section 110, a first discontinuity observed by a guided wave is a smooth discontinuity rather than an abrupt one. By creating this smooth discontinuity, strong back reflections that often occur at the first discontinuity are eliminated and the energy of the guided wave is passed onto the antenna and radiates away. This results in a very broadband matching performance.

The ground plane section 110 is positioned in the buffer zone 120 that separates the radiating element 114 from the ground plane 112. I.e., the antenna dedicated volume that includes both the antenna itself and the buffer volume does not increase over a volume of such an antenna without the added ground plane section.

In certain embodiments, the modified ground plane section 110 is partially etched at the interconnection with the horizontal ground plane to provide a slit 130 between the modified ground plane section 110 and the ground plane 112 where the modified ground plane section 110 is electrically coupled with the ground plane 112 via a shorting pin 132 with a width of about 1 mm (+/−0.2 mm). This shorting pin provides an additional current path making the modified ground plane section 110 function as a balun that further improves the antenna match at broadband frequencies. Thus, the shorting pin counters the current flow within the radiating element 114. In certain embodiments, the shorting pin is positioned along an edge 134 of the modified ground plane section 110 and an edge 136 of the ground plane 112. Where the edges 134 and 136 are determined relative to an outside edge of the radiating element 114.

In certain embodiments, the radiating element 114 further includes a monopole microstrip radiator feed element 140. The monopole microstrip radiator feed element 140 further includes a section 142 positioned separate but parallel to the ground plane 112 such that excitation occurs between the radiator feed element 140 and the ground plane 112. The monopole radiator feed element 140 also includes a curved portion 144 which extends parallel with the curve of the modified ground plane section 110.

Figure 3:
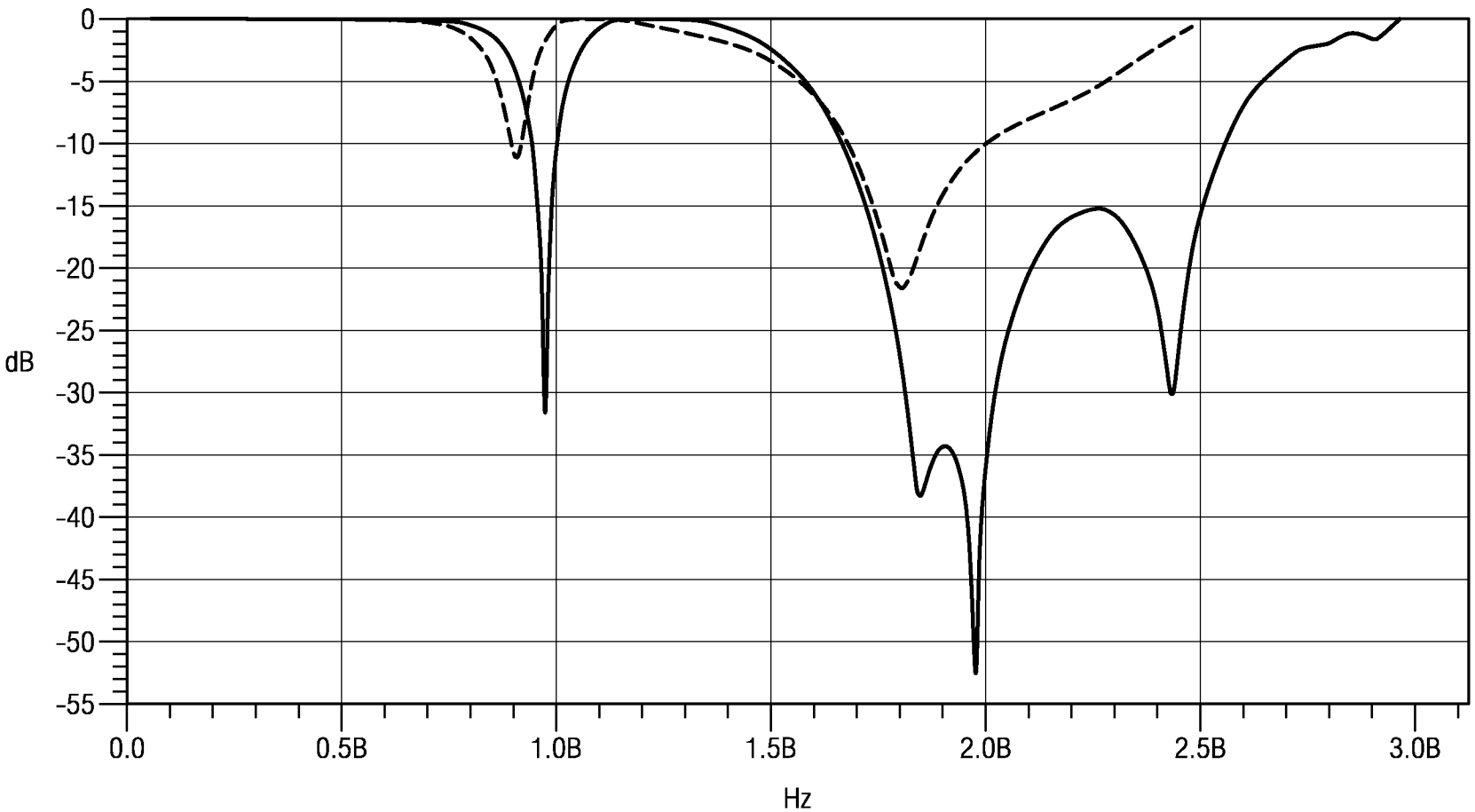
FIG. 3 shows a graph of example performance of an antenna in accordance with the present invention.
Figure 4A:
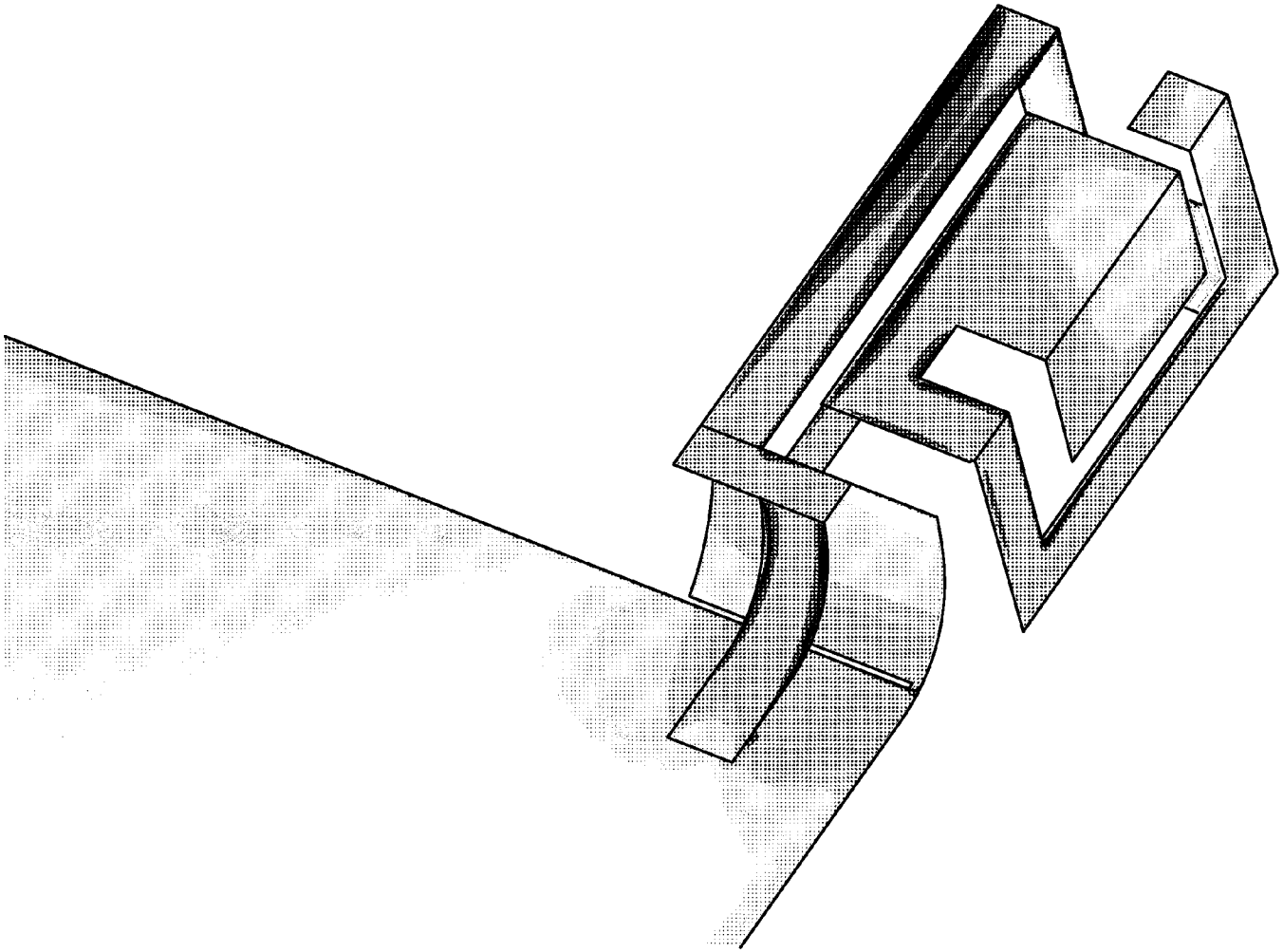
FIGS. 4A-4D show perspective views of current distributions within an antenna in accordance with the present invention.
Figure 4B:
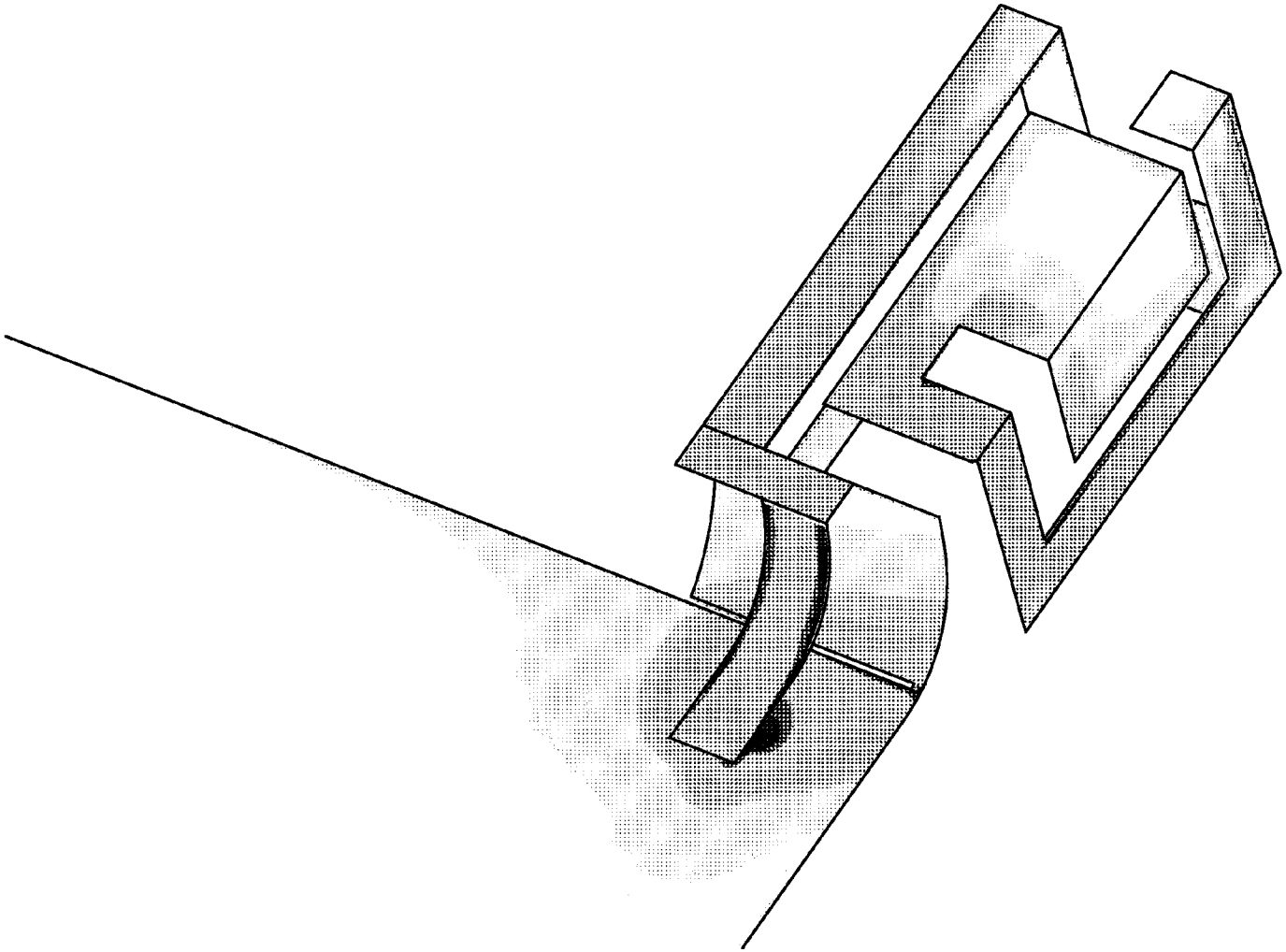
Figure 4C:
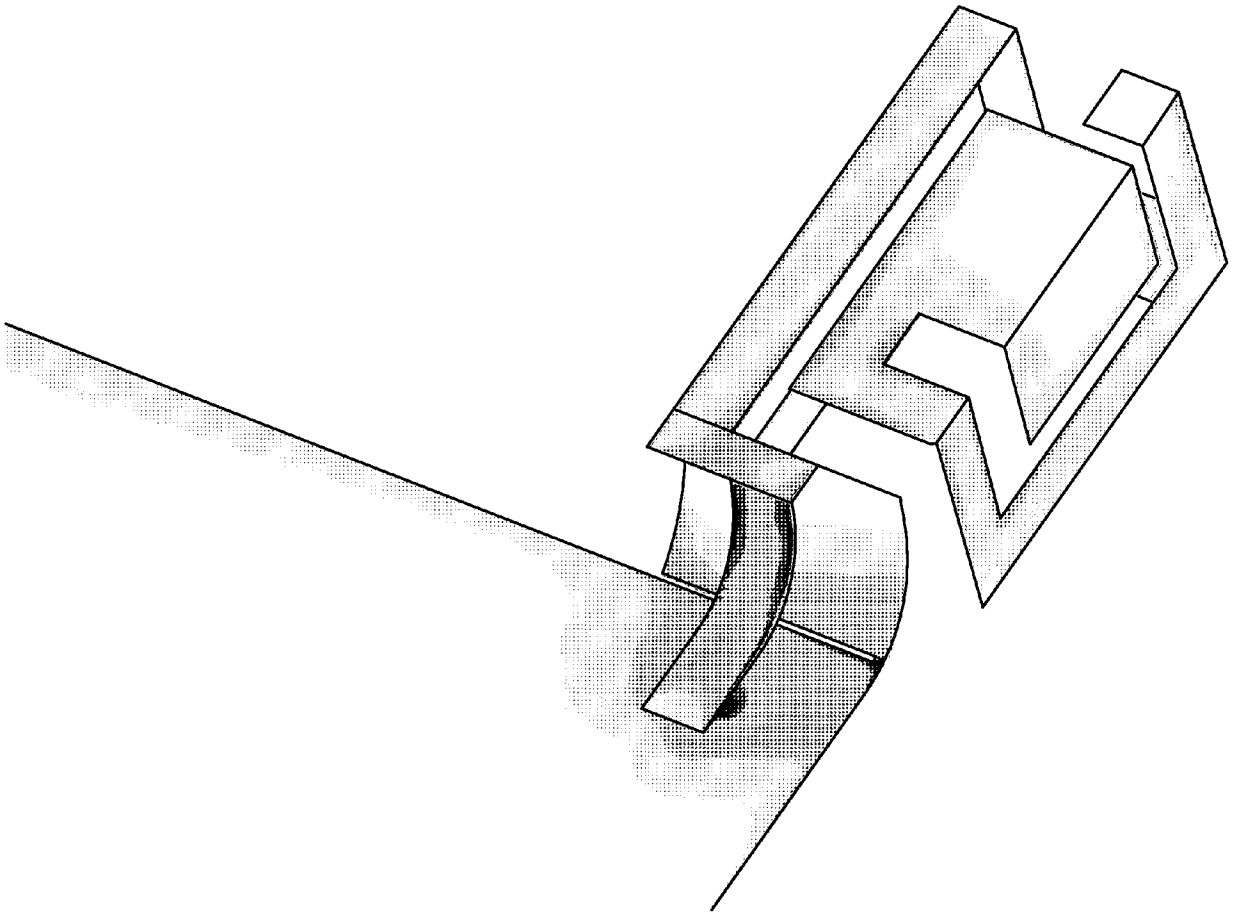
Figure 4D:
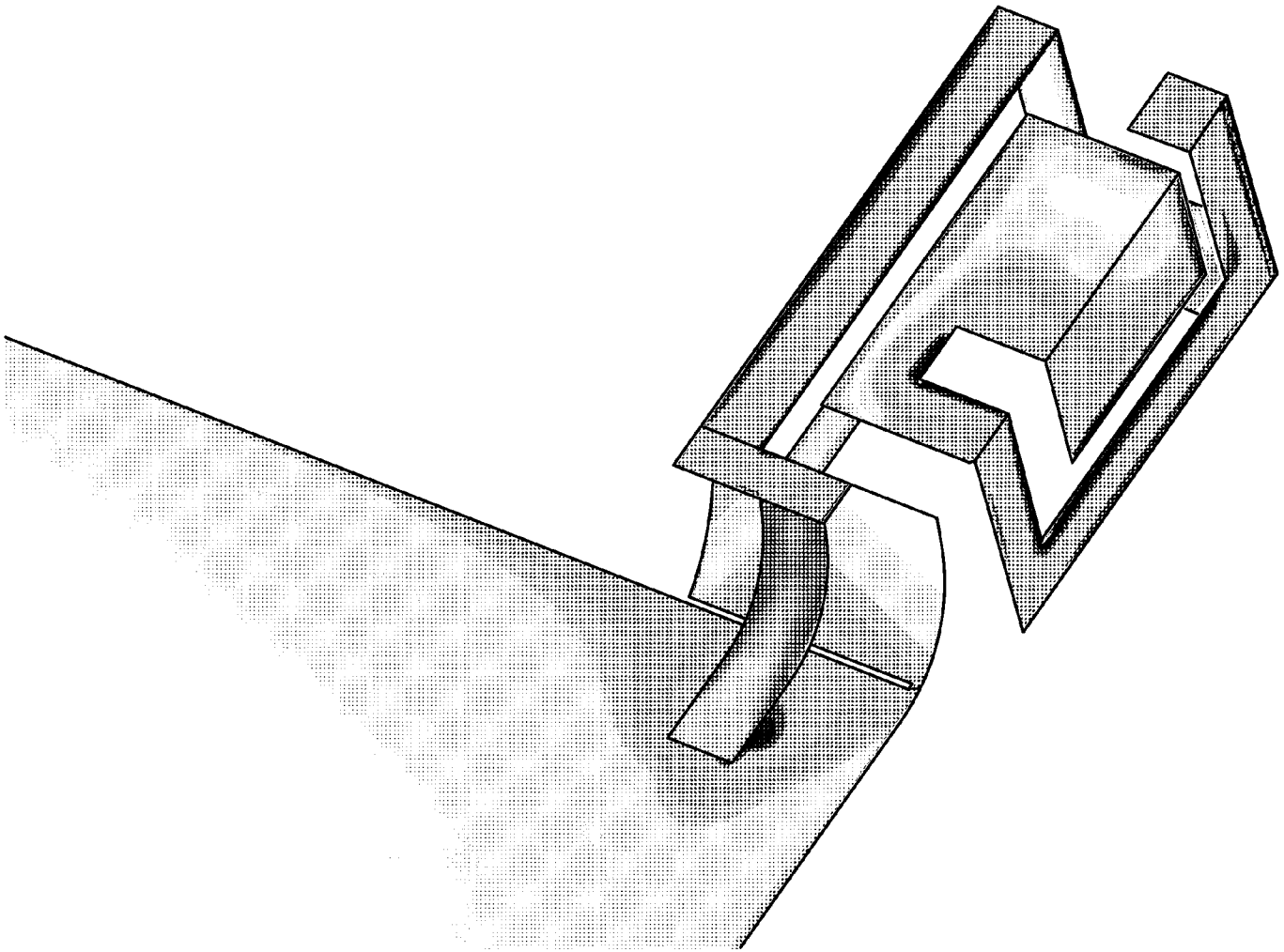

FIG. 3 shows a graph of example performance of an antenna in accordance with the present invention. The dashed line of the graph of FIG. 3 represents an initial quad band antenna performance. The solid line of the graph of FIG. 3 represents an improved performance of a sept band antenna 100 having a modified ground plane section 110. As shown in the example performance, the modified ground plane technique (MGP) significantly improves the antenna matching where excellent matching properties at all the frequency bands of interest (e.g., frequency bands from 800 MHz to 2.4 GHz) can be demonstrated without the need to use a complicated matching lumped element network.

FIGS. 4A-4D show perspective views of current distributions within an antenna in accordance with the present invention. Specifically, FIGS. 4A, 4B, 4C and 4D shows perspective views of current distributions at 980 MHz, 1700 MHz, 2000 MHz and 2500 MHz, respectively. From these current distributions, it can be seen that the antenna 100 presents a current with a smooth transition with frequency which makes the structure broadband. It can also be seen that providing the antenna 110 with the etch between the modified ground plane section 110 and the ground plane 112 provides additional current paths that balance the currents on the structure of the antenna and provides further broadband performance.

Figure 5:
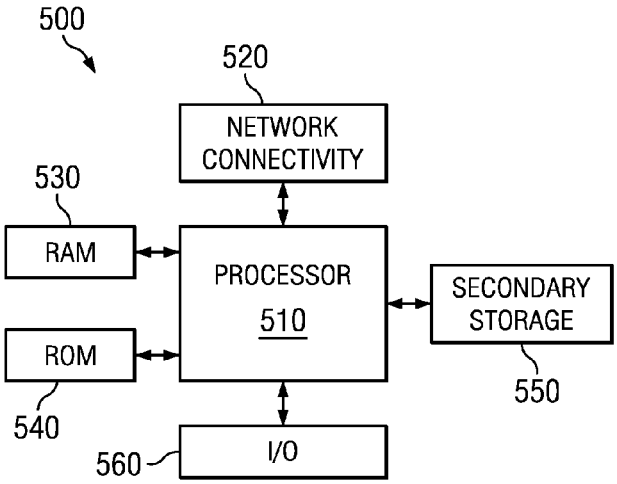
FIG. 5 shows an exemplary system in which the present invention may be implemented.

FIG. 5 illustrates an example of a system 500 suitable for implementing one or more embodiments disclosed herein. In various embodiments, the system 500 comprises a processor 510, which may be referred to as a central processor unit (CPU) or digital signal processor (DSP), network connectivity devices 520, random access memory (RAM) 530, read only memory (ROM) 540, secondary storage 550, and input/output (I/O) devices 560. In some embodiments, some of these components may not be present or may be combined in various combinations with one another or with other components not shown. These components may be located in a single physical entity or in more than one physical entity. Any actions described herein as being taken by the processor 510 might be taken by the processor 510 alone or by the processor 510 in conjunction with one or more components shown or not shown in FIG. 5.

The processor 510 executes instructions, codes, computer programs, or scripts that it might access from the network connectivity devices 520, RAM 530, or ROM 540. While only one processor 510 is shown, multiple processors may be present. Thus, while instructions may be discussed as being executed by a processor 510, the instructions may be executed simultaneously, serially, or otherwise by one or multiple processors 510 implemented as one or more CPU chips.

In various embodiments, the network connectivity devices 520 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 520 may enable the processor 510 to communicate with the Internet or one or more telecommunications networks or other networks from which the processor 510 might receive information or to which the processor 510 might output information.

The network connectivity devices 520 may also be capable of transmitting or receiving data wirelessly in the form of electromagnetic waves, such as radio frequency signals or microwave frequency signals. Information transmitted or received by the network connectivity devices 520 may include data that has been processed by the processor 510 or instructions that are to be executed by processor 510. The data may be ordered according to different sequences as may be desirable for either processing or generating the data or transmitting or receiving the data.

In various embodiments, the RAM 530 may be used to store volatile data and instructions that are executed by the processor 510. The ROM 540 shown in FIG. 5 may be used to store instructions and perhaps data that are read during execution of the instructions. Access to both RAM 530 and ROM 540 is typically faster than to secondary storage 550. The secondary storage 550 is typically comprised of one or more disk drives or tape drives and may be used for non-volatile storage of data or as an over-flow data storage device if RAM 530 is not large enough to hold all working data. Secondary storage 550 may be used to store programs that are loaded into RAM 530 when such programs are selected for execution. The I/O devices 560 may include liquid crystal displays (LCDs), touch screen displays, keyboards, keypads, switches, dials, mice, track balls, voice recognizers, card readers, paper tape readers, printers, video monitors, or other well-known input/output devices.

Figure 6:
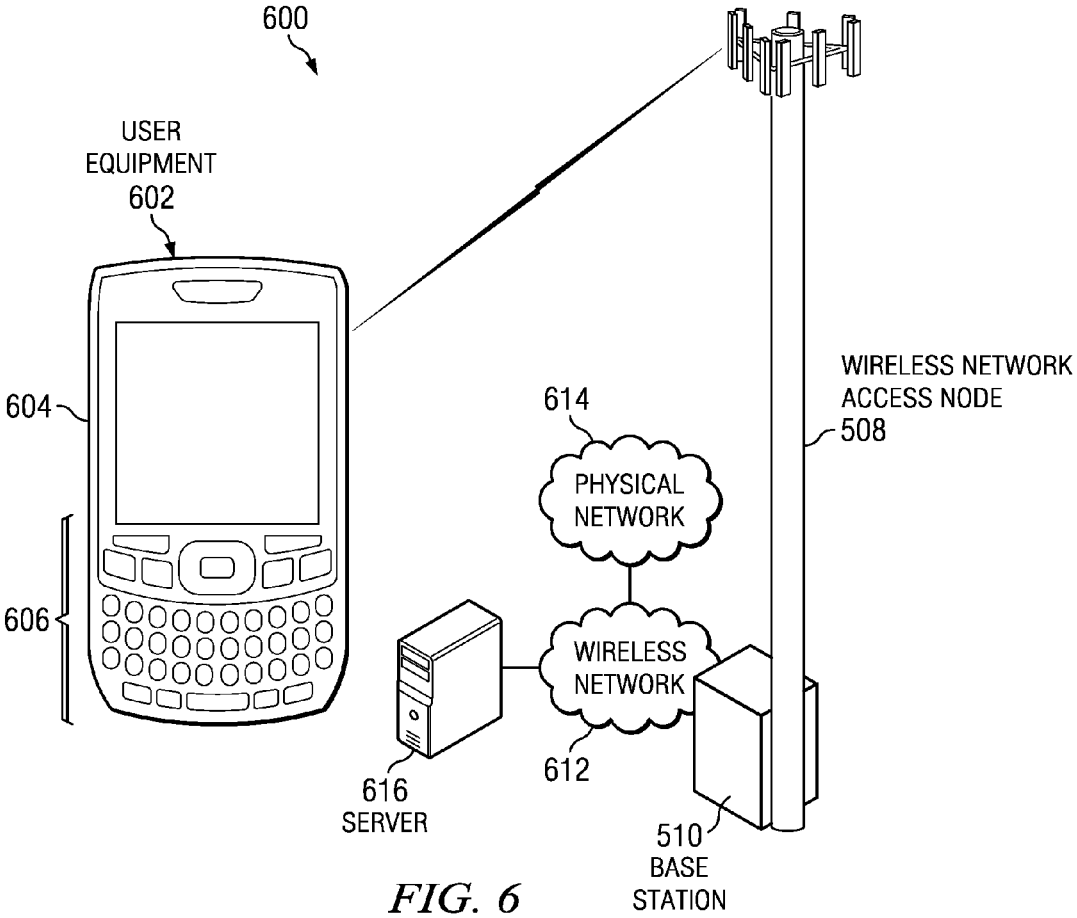
FIG. 6 shows a wireless communications system including an embodiment of a user equipment (UE)

FIG. 6 shows a wireless communications system including an embodiment of user equipment (UE) 602. Though illustrated as a mobile phone, the UE 602 may take various forms including a wireless handset, a pager, a personal digital assistant (PDA), a portable computer, a tablet computer, or a laptop computer. Many suitable devices combine some or all of these functions. In some embodiments, the UE 602 is not a general purpose computing device like a portable, laptop or tablet computer, but rather is a special-purpose communications device such as a mobile phone, a wireless handset, a pager, a PDA, or a telecommunications device installed in a vehicle. The UE 602 may likewise be a device, include a device, or be included in a device that has similar capabilities but that is not transportable, such as a desktop computer, a set-top box, or a network node. In these and other embodiments, the UE 602 may support specialized activities such as gaming, inventory control, job control, and/or task management functions, and so on.

In various embodiments, the UE 602 includes a display 604. The UE 602 likewise include a touch-sensitive surface, a keyboard or other input keys 606 generally used for input by a user. In these and other environments, the keyboard may be a full or reduced alphanumeric keyboard such as QWERTY, Dvorak, AZERTY, and sequential keyboard types, or a traditional numeric keypad with alphabet letters associated with a telephone keypad. The input keys may likewise include a trackwheel, an exit or escape key, a trackball, and other navigational or functional keys, which may be inwardly depressed to provide further input function. The UE 602 may likewise present options for the user to select, controls for the user to actuate, and cursors or other indicators for the user to direct.

The UE 602 may further accept data entry from the user, including numbers to dial or various parameter values for configuring the operation of the UE 602. The UE 602 may further execute one or more software or firmware applications in response to user commands. These applications may configure the UE 602 to perform various customized functions in response to user interaction. Additionally, the UE 602 may be programmed or configured over-the-air (OTA), for example from a wireless base station 610, a server 616, a wireless network access node 608, or a peer UE 602.

Among the various applications executable by the UE 500 are a web browser, which enables the display 604 to display a web page. The web page may be obtained via wireless communications with a wireless network access node 608, such as a cell tower, a peer UE 602, or any other wireless communication network 612 or system. In various embodiments, the wireless network 612 is coupled to a wired network 614, such as the Internet. Via the wireless network 612 and the wired network 614, the UE 602 has access to information on various servers, such as a server 616. The server 616 may provide content that may be shown on the display 604. Alternately, the UE 602 may access the wireless network 612 through a peer UE 602 acting as an intermediary, in a relay type or hop type of connection. Skilled practitioners of the art will recognized that many such embodiments are possible and the foregoing is not intended to limit the spirit, scope, or intention of the disclosure.

Figure 7:
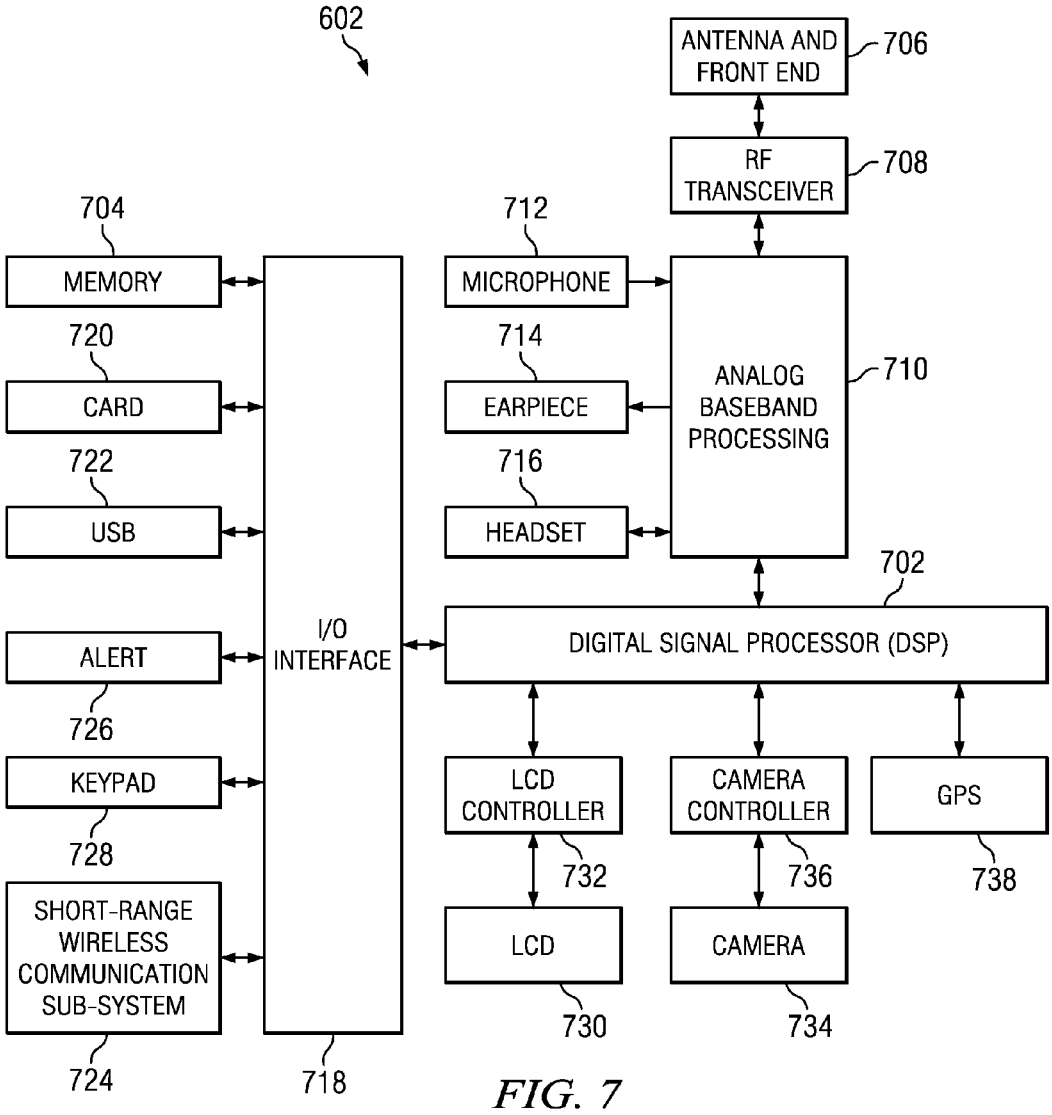
FIG. 7 is a simplified block diagram of an exemplary UE comprising a digital signal processor (DSP)

FIG. 7 depicts a block diagram of an exemplary user equipment (UE) 602 in which the present invention may be implemented. While various components of a UE 602 are depicted, various embodiments of the UE 602 may include a subset of the listed components or additional components not listed. As shown in FIG. 7, the UE 602 includes a digital signal processor (DSP) 702 and a memory 704. As shown, the UE 602 may further include an antenna and front end unit 706 (which may include e.g., antenna 100), a radio frequency (RF) transceiver 708, an analog baseband processing unit 710, a microphone 712, an earpiece speaker 714, a headset port 716, an input/output (I/O) interface 718, a removable memory card 720, a universal serial bus (USB) port 722, a short range wireless communication sub-system 724, an alert 726, a keypad 728, a liquid crystal display (LCD) 730, which may include a touch sensitive surface, an LCD controller 732, a charge-coupled device (CCD) camera 734, a camera controller 736, and a global positioning system (GPS) sensor 738. In various embodiments, the UE 602 may include another kind of display that does not provide a touch sensitive screen. In an embodiment, the DSP 702 may communicate directly with the memory 704 without passing through the input/output interface 718.

In various embodiments, the DSP 702 or some other form of controller or central processing unit (CPU) operates to control the various components of the UE 602 in accordance with embedded software or firmware stored in memory 704 or stored in memory contained within the DSP 702 itself. In addition to the embedded software or firmware, the DSP 702 may execute other applications stored in the memory 704 or made available via information carrier media such as portable data storage media like the removable memory card 720 or via wired or wireless network communications. The application software may comprise a compiled set of machine-readable instructions that configure the DSP 702 to provide the desired functionality, or the application software may be high-level software instructions to be processed by an interpreter or compiler to indirectly configure the DSP 702.

The antenna and front end unit 706 may be provided to convert between wireless signals and electrical signals, enabling the UE 602 to send and receive information from a cellular network or some other available wireless communications network or from a peer UE 602. In an embodiment, the antenna and front end unit 506 may include multiple antennas to support beam forming and/or multiple input multiple output (MIMO) operations. As is known to those skilled in the art, MIMO operations may provide spatial diversity which can be used to overcome difficult channel conditions or to increase channel throughput. Likewise, the antenna and front end unit 706 may include antenna tuning or impedance matching components, RF power amplifiers, or low noise amplifiers.

In various embodiments, the RF transceiver 708 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 710 or the DSP 702 or other central processing unit. In some embodiments, the RF Transceiver 508, portions of the Antenna and Front End 706, and the analog base band processing unit 710 may be combined in one or more processing units and/or application specific integrated circuits (ASICs).

The analog baseband processing unit 710 may provide various analog processing of inputs and outputs, for example analog processing of inputs from the microphone 712 and the headset 716 and outputs to the earpiece 714 and the headset 716. To that end, the analog baseband processing unit 710 may have ports for connecting to the built-in microphone 712 and the earpiece speaker 714 that enable the UE 602 to be used as a cell phone. The analog baseband processing unit 710 may further include a port for connecting to a headset or other hands-free microphone and speaker configuration. The analog baseband processing unit 710 may provide digital-to-analog conversion in one signal direction and analog-to-digital conversion in the opposing signal direction. In various embodiments, at least some of the functionality of the analog baseband processing unit 710 may be provided by digital processing components, for example by the DSP 702 or by other central processing units.

The DSP 702 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 702 may perform modulation, coding, interleaving, and spreading, and for a receiver function the DSP 702 may perform despreading, deinterleaving, decoding, and demodulation. In another embodiment, for example in an orthogonal frequency division multiplex access (OFDMA) technology application, for the transmitter function the DSP 702 may perform modulation, coding, interleaving, inverse fast Fourier transforming, and cyclic prefix appending, and for a receiver function the DSP 702 may perform cyclic prefix removal, fast Fourier transforming, deinterleaving, decoding, and demodulation. In other wireless technology applications, yet other signal processing functions and combinations of signal processing functions may be performed by the DSP 702.

The DSP 702 may communicate with a wireless network via the analog baseband processing unit 710. In some embodiments, the communication may provide Internet connectivity, enabling a user to gain access to content on the Internet and to send and receive e-mail or text messages. The input/output interface 718 interconnects the DSP 702 and various memories and interfaces. The memory 704 and the removable memory card 720 may provide software and data to configure the operation of the DSP 702. Among the interfaces may be the USB interface 722 and the short range wireless communication sub-system 724. The USB interface 722 may be used to charge the UE 602 and may also enable the UE 602 to function as a peripheral device to exchange information with a personal computer or other computer system. The short range wireless communication sub-system 724 may include an infrared port, a Bluetooth interface, an IEEE 802.11 compliant wireless interface, or any other short range wireless communication sub-system, which may enable the UE 602 to communicate wirelessly with other nearby mobile devices and/or wireless base stations.

The input/output interface 718 may further connect the DSP 702 to the alert 726 that, when triggered, causes the UE 602 to provide a notice to the user, for example, by ringing, playing a melody, or vibrating. The alert 726 may serve as a mechanism for alerting the user to any of various events such as an incoming call, a new text message, and an appointment reminder by silently vibrating, or by playing a specific preassigned melody for a particular caller.

The keypad 728 couples to the DSP 702 via the I/O interface 718 to provide one mechanism for the user to make selections, enter information, and otherwise provide input to the UE 602. The keyboard 728 may be a full or reduced alphanumeric keyboard such as QWERTY, Dvorak, AZERTY and sequential types, or a traditional numeric keypad with alphabet letters associated with a telephone keypad. The input keys may likewise include a trackwheel, an exit or escape key, a trackball, and other navigational or functional keys, which may be inwardly depressed to provide further input function. Another input mechanism may be the LCD 730, which may include touch screen capability and also display text and/or graphics to the user. The LCD controller 732 couples the DSP 702 to the LCD 730.

The CCD camera 734, if equipped, enables the UE 602 to take digital pictures. The DSP 702 communicates with the CCD camera 734 via the camera controller 736. In another embodiment, a camera operating according to a technology other than Charge Coupled Device cameras may be employed. The GPS sensor 738 is coupled to the DSP 702 to decode global positioning system signals, thereby enabling the UE 602 to determine its position. Various other peripherals may also be included to provide additional functions, such as radio and television reception.

Figure 8:
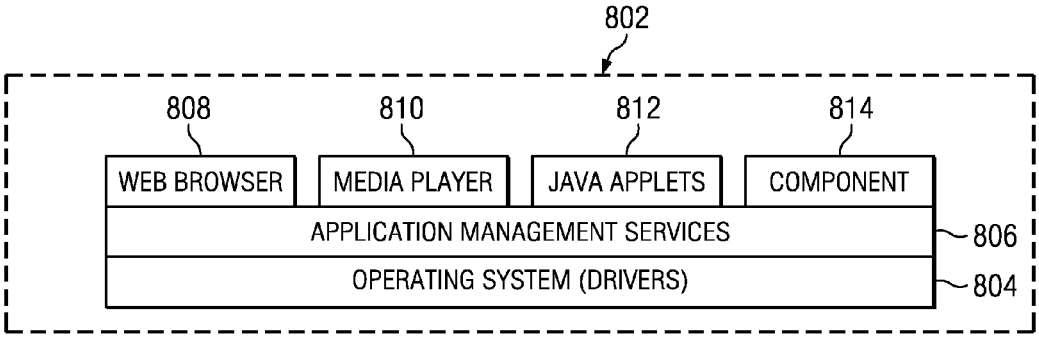
FIG. 8 is a simplified block diagram of a software environment that may be implemented by the DSP.

FIG. 8 illustrates a software environment 802 that may be implemented by the DSP 702. The DSP 702 executes operating system drivers 804 that provide a platform from which the rest of the software operates. The operating system drivers

804 provide drivers for the UE 602 hardware with standardized interfaces that are accessible to application software. The operating system drivers 804 include application management services (AMS) 806 that transfer control between applications running on the UE 602. Also shown in FIG. 8 are a web browser application 808, a media player application 810, and Java applets 812. The web browser application 808 configures the UE 602 to operate as a web browser, allowing a user to enter information into forms and select links to retrieve and view web pages. The media player application 810 configures the UE 602 to retrieve and play audio or audiovisual media. The Java applets 812 configure the UE 602 to provide games, utilities, and other functionality. A component 814 might provide functionality described herein. The UE 602, a base station 610, and other components described herein might include a processing component that is capable of executing instructions related to the actions described above.

What is claimed is:

1. An antenna comprising:

a ground plane;

a radiating element; and a ground plane element having one end contiguous with and extending from the ground plane and an opposite end raised relative to the ground plane and positioned between the ground plane and the radiating element, the opposite end maintained in a spaced non contact relationship to the ground plane and the radiating element, the ground plane element being curved from the one end to the opposite end such that a smooth transition of the current distribution on a surface of the ground plane element is achieved.

2. The antenna of claim 1 wherein the smooth transition of the current distribution on the surface of the ground plane element allows for a broader bandwidth.

3. The antenna of claim 2 wherein the ground plane element is curved away from the ground plane, curvature of the ground plane element is such that the opposite end of the ground plane element is perpendicular to the ground plane.

4. The antenna of claim 2 wherein the radiating element further comprises a radiator feed element, radiator feed element comprising a section positioned separate but parallel to the ground plane such that excitation occurs between the radiator feed element and the ground plane, the radiator feed element further comprising a curved portion, the curved portion extending parallel with the curvature of the ground plane element.

5. The antenna of claim 1 wherein the ground plane and the ground plane element are electrically connected.

6. The antenna of claim 5 wherein the narrow-band antenna comprises a quad-band antenna supporting 800/900/1800/1900 MHz and the ground plane element enables the antenna to function as a sept-band antenna supporting GSM 800/900/1800/1900, UNITS 2100, Bluetooth 2450, and a proposed LTE 2600 MHz band.

7. The antenna of claim 1 wherein the ground plane element allows a narrow-band antenna to be made broader such that antenna supports a plurality of frequency bands.

8. The antenna of claim 1, wherein the ground plane element is configured to function as a balun.

9. The antenna of claim 8, wherein the one end of the ground plane element is separated from the ground plane by a slit and including a shorting pin connecting the one end to the ground plane.

10. A user equipment (UE) comprising:

a processor; and an antenna coupled to the processor, the antenna comprising a ground plane;

a radiating element; and a ground plane element having one end contiguous with and extending from the ground plane and an opposite end raised relative to the ground plane and positioned between the ground plane and the radiating element, the opposite end maintained in a spaced non contact relationship to the ground plane and the radiating element, the ground plane element being curved from the one end to the opposite end such that a smooth transition of the current distribution on a surface of the ground plane element is achieved.

11. The antenna of claim 10 wherein the smooth transition of the current distribution on the surface of the ground plane element allows for a broader bandwidth.

12. The UE of claim 10 wherein the ground plane element is curved away from the ground plane, curvature of the ground plane element is such that the opposite end of the ground plane element is perpendicular to the ground plane.

13. The UE of claim 12 wherein the radiating element further comprises a radiator feed element, radiator feed element comprising a section positioned separate but parallel to the ground plane such that excitation occurs between the radiator feed element and the ground plane, the radiator teed element further comprising a curved portion, the curved portion extending parallel with the curvature of the ground plane element.

14. The UE of claim 10 wherein the ground plane and the ground plane element are electrically connected.

15. The UE of claim 10 wherein the ground plane element allows a narrow-band antenna to be made broader such that antenna supports a plurality of frequency bands.

16. The UE of claim 15 wherein the narrow-band antenna comprises a quad-band antenna supporting 800/900/1800/1900 MHz and the ground plane element enables the antenna to function as a sept-hand antenna supporting GSM 800/900/1800/1900, UNITS 2100, Bluetooth 2450, and a proposed LTE 2600 MHz band.

17. The antenna of claim 10, wherein the ground plane element is configured to function as a balun.

18. The antenna of claim 17, wherein the one end of the ground plane element is separated from the ground plane by a slit and including a shorting pin connecting the one end to the ground plane.

* * * * *